US006257843B1

(12) United States Patent
Cook et al.

(10) Patent No.: US 6,257,843 B1
(45) Date of Patent: Jul. 10, 2001

(54) SELF-ALIGNING DOUBLE-ACTING SIMPLEX PLUNGER PUMP

(75) Inventors: James E. Cook, Anoka; O. Harald S. Eriksen, Brooklyn Park, both of MN (US)

(73) Assignee: Pumptec, Inc., Anoka, MN (US)

( * ) Notice: Subject to any disclaimer, the term of this patent is extended or adjusted under 35 U.S.C. 154(b) by 0 days.

(21) Appl. No.: 09/560,264

(22) Filed: Apr. 26, 2000

(51) Int. Cl.[7] ..... F04B 17/03
(52) U.S. Cl. ..... 417/360; 417/415; 417/537
(58) Field of Search ..... 417/360, 415, 417/534, 537, 535, 536

(56) References Cited

U.S. PATENT DOCUMENTS 4,978,284 * 12/1990 Cook et al. ..... 417/534
5,058,485 * 10/1991 Cardillo ..... 417/269
5,173,039 12/1992 Cook .
5,183,396 2/1993 Cook et al. .

* cited by examiner

*Primary Examiner*—Michael Koczo
(74) *Attorney, Agent, or Firm*—Roger W. Jensen

(57) ABSTRACT

A self-aligning double-acting simplex plunger pump comprising first and second combined plunger stuffing box and head members or blocks. A manifold is adapted to be abutted against one surface of the blocks and second spaced apart parallel surfaces of the blocks are abutted against the axial end face of a motor. Alignment means on the motor and on the blocks assure proper alignment of the blocks with respect to a piston driven by the motor which reciprocates between the blocks along a longitudinal axis.

5 Claims, 4 Drawing Sheets

SELF-ALIGNING DOUBLE-ACTING SIMPLEX PLUNGER PUMP

BACKGROUND OF THE INVENTION

This invention pertains to an improvement in hydraulic pumps and is generically applicable to double-acting simplex plunger pumps of both the "plunger" and "piston" types.

Pertinent prior art includes U.S. Pat. No. 5,173,039 issued to the present applicant Dec. 22, 1992, and U.S. Pat. No. 5,183,396 issued to James E. Cook & O. Harald S.

Erikson on Feb. 2, 1993. The latter patent discloses an alignment means comprising in part check valves for maintaining alignment of a pair of spaced-apart combined-plunger stuffing box and head members, and the reciprocating plunger or piston.

The present invention provides an improvement over the above-mentioned patents by providing a unique self-aligning system for the combined plunger-stuffing box head members and the plunger. My present invention lends itself to much reduced manufacturing costs, as well as higher reliability and precision alignment of the aforesaid parts.

SUMMARY OF THE INVENTION

The present invention provides an improved alignment system for a double-acting simplex plunger pump. In broad terms, this invention provides alignment means on the motor end face engaging surface of the combined plunger stuffing box and head members, which alignment means co act with additional alignment means in the end face of the drive motor for the pump.

DETAILED DESCRIPTION OF THE PREFERRED EMBODIMENTS

Figure 1:
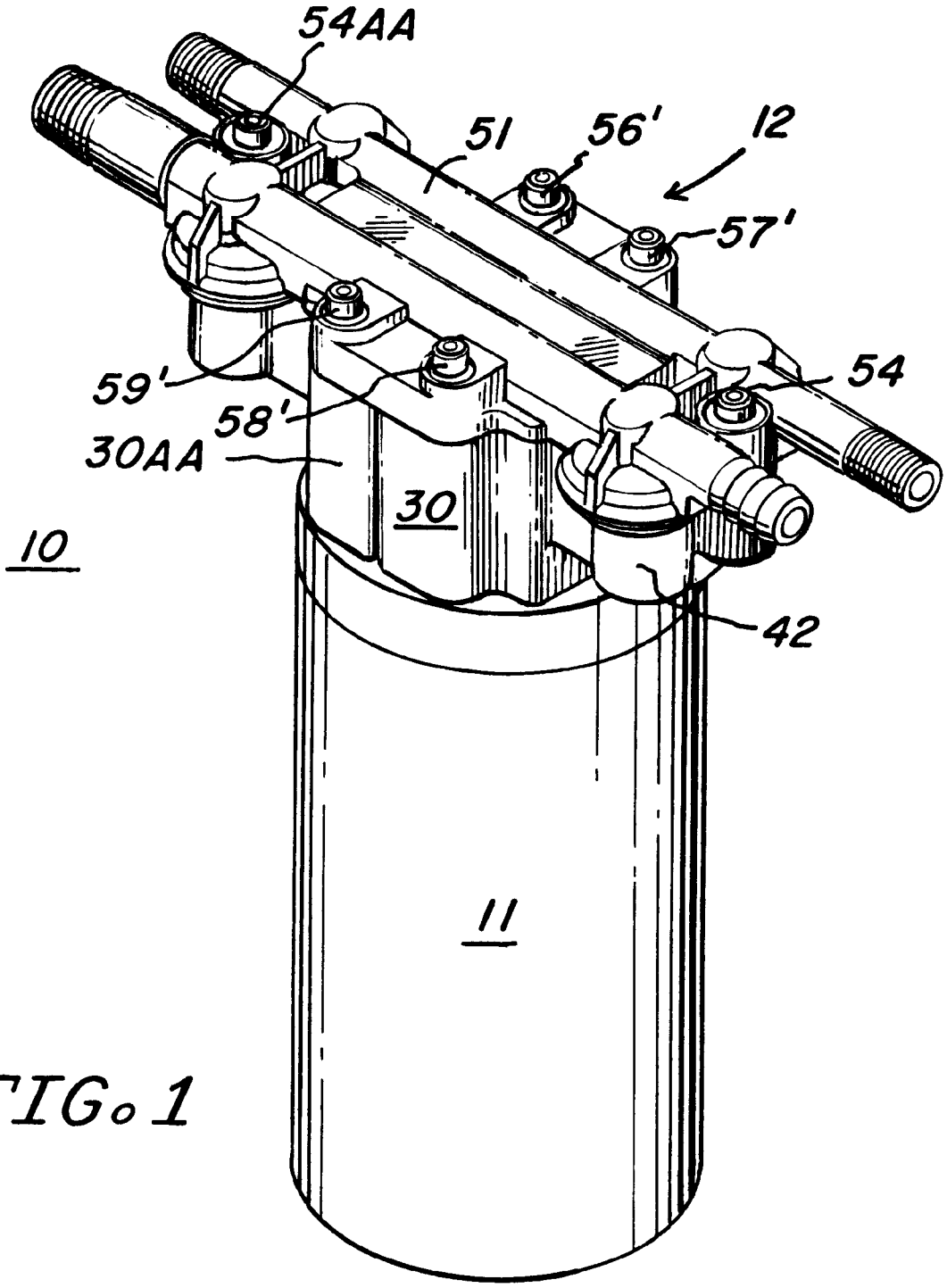
FIG. 1 is a top left isometric view of the assembled pump 10 comprising in part a drive motor 11.
Figure 2:
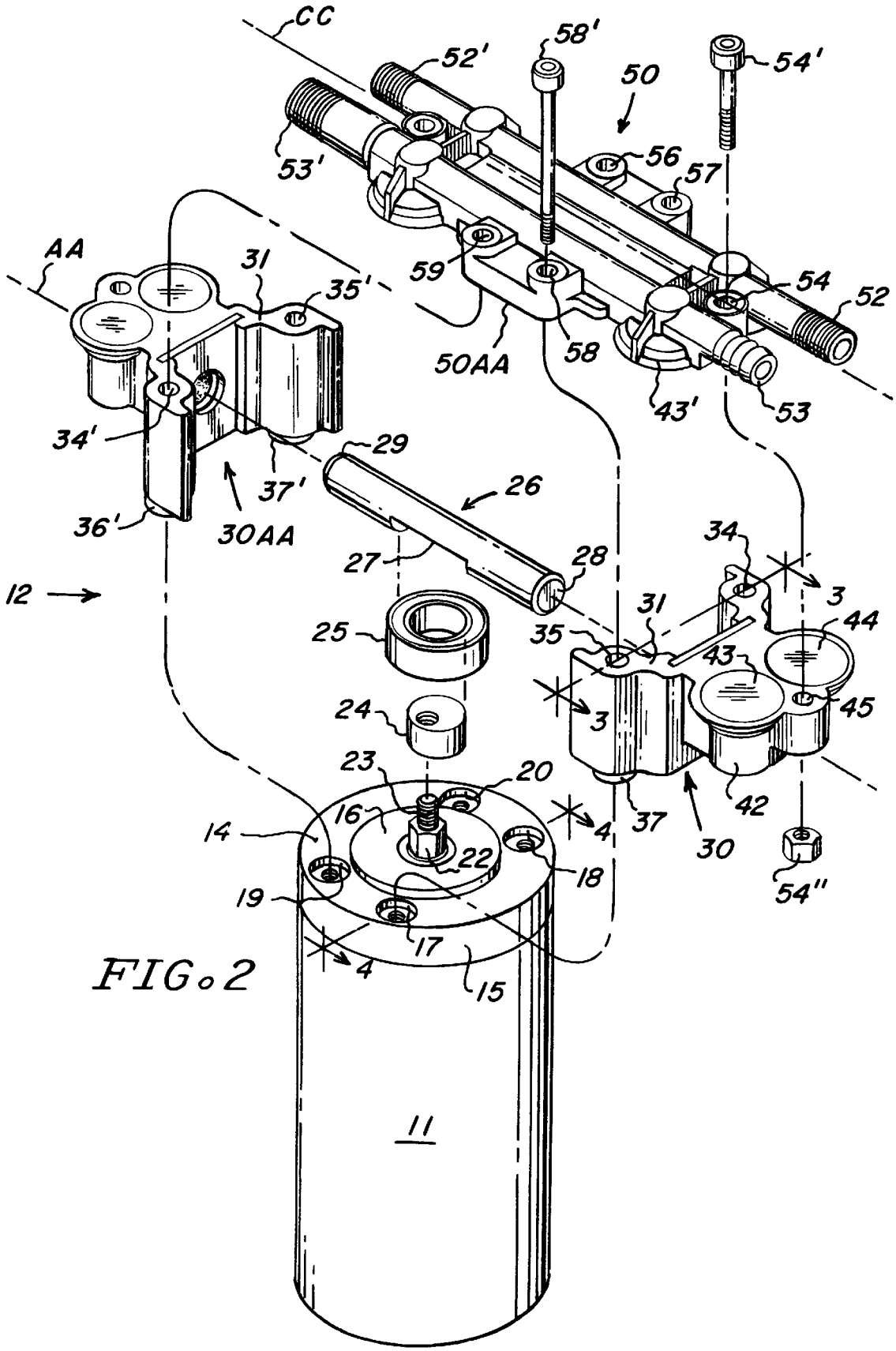
FIG. 2 is an isometric exploded view of the apparatus shown in FIG. 1.
Figure 3:
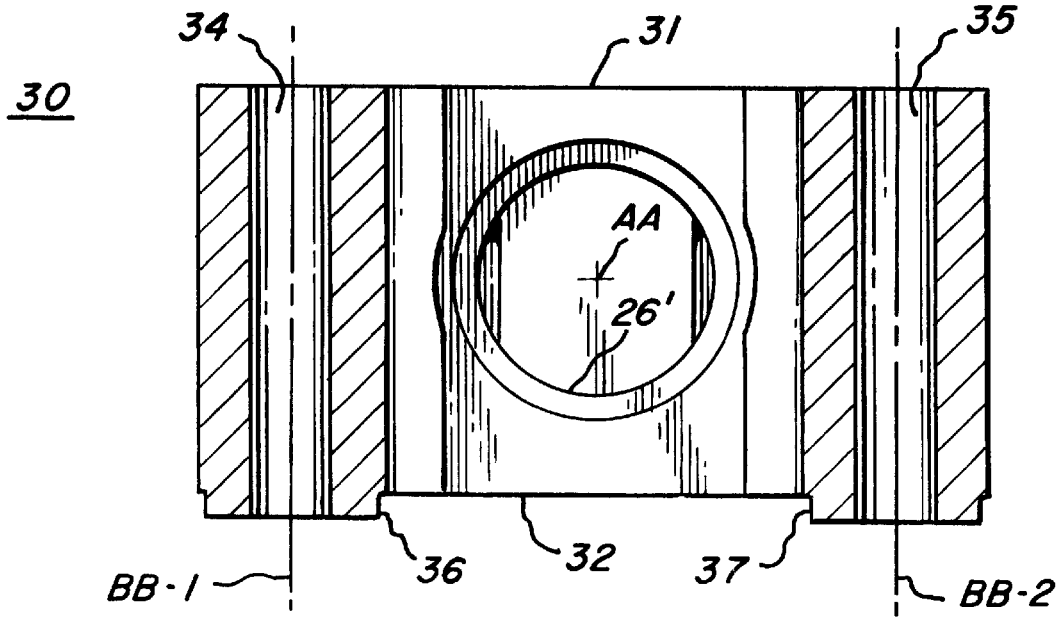
FIG. 3 is a cross section of a combined plunger stuffing box and head member 30 as viewed along section lines 3—3 of FIG. 2.

Referring to FIGS. 1 and 2, the reference numeral 10 is used to designate the entire improved pump comprising, in part, a suitable electric motor 11, the pump per se being designated by reference numeral 12. In broad terms, the pump 12 comprises a pair of combined stuffing box and head members 30 and 30AA, a double-ended piston or plunger 26, a manifold 50, and an eccentric drive means 24, 25 and 27connected to the piston 26 as will be discussed in more detail below. The combined plunger stuffing box and head member 30 is shown in cross section in FIG. 3 having two spaced apart parallel surfaces 31 and 32, respectively designated a pump manifold engaging surface and a motor end face engaging surface. Member 30 further has a plunger receiving recess 26' for receiving one end 28 of the piston 26, the other end 29 of which co-acts with a similar recess in member or block 30AA; the recess 26' has a longitudinal axis AA lying parallel to and between the spaced apart parallel surfaces 31 and 32. Members or blocks 30 and 30AA each have a pair of spaced apart parallel bores, i.e., bores 34 and 35 for block 30 and bores 34' and 35' for block 30AA. The bores 34 and 35 for block 30 are shown in greater detail in FIG. 3; their longitudinal axes are respectively designated BB-1 and BB-2; these axes lie in a plane perpendicular to the longitudinal axis AA. As shown in FIG. 3, the bores 34 and 35 extend through the block 30 between and transverse to the spaced apart parallel surfaces 31 and 32, and are disposed on opposite sides of the longitudinal axis AA.

The blocks 30 and 30AA further include on the motor end face engaging surface thereof a pair of alignment means. More specifically, for block 30 as shown in FIGS. 2 and 3, a pair of alignment means 36 and 37 in the form of bosses, project beyond the plane of the motor end face engaging surface 32; the bosses 36 and 37 are concentric, respectively, with bores 34 and 35, and have preselected diameters. The bosses for block 30AA are identified by reference numerals 36' and 37'.

The motor 11 has an axial end face 14 with a central extending portion which, in turn, has an axial end face 16. The output shaft of the motor is shown in FIG. 2 is centered and has a threaded extension 23 adapted to receive and hold a cam member 24 which seats within a bearing 25, the outer diameter of which is adapted to fit within a crank-engagable recess 27 in the plunger or piston 26. Thus the assembled cam means 24 and bearing 25 form a crank means for co-acting with the recess 27 for causing reciprocation of the piston 26 upon rotation of the output shaft of the motor 11.

Two sets of alignment means are provided in the motor end face 14, the first set being circular recesses 17 and 18, and the second set being circular recesses 19 and 20, and shown clearly in FIG. 2. Recesses 17 and 18 are shown in cross section in FIG. 4; recesses 17–19 all are of preselected diameters so as to receive, on a tight fit basis, the bosses 36/37 and 36'/37'.

Threaded means 17' and 18' are provided in the motor end face concentric with the recesses 17 and 18. The axes for threaded means or bores 17' and 18' are respectively designated as DD-1 and DD-2, the spacing between which is identical to the spacing between bores BB-1 and BB-2 of the block 30.

It will be understood, therefore, that the blocks 30 and 30AA may be assembled with the motor 11 by having the recesses 36/37 and 36'/37' respectively seated into recesses 18/17 and 19/20.

The manifold 50 has a longitudinal axis CC and a bottom flat surface 50AA adapted to be abutted against the top or pump manifold-engaging surfaces 31 of the first and second members or blocks 30 and 30AA. The manifold is generally similar to that shown in the above-mentioned patents issued to the applicant, which disclosures are incorporated herein for reference. In general, the manifold has two conduits, the first having two ends 52 and 52', and the second having two ends 53 and 53', spaced apart on opposite sides and parallel to the axis CC. Importantly, for the present invention, the manifold has a plurality of centrally positioned and spaced apart transverse bores normal to the manifold longitudinal axis CC, i.e., bores 56, 57, 58 and 59, shown clearly in FIG. 2. The axes of bores 56–59 are preselected so as to exactly match with the axes of the threaded bores in the end face of motor 11. For example, the axes of bores 57 and 58 are spaced apart so as to match exactly the spacing between axes DD-1 and DD-2, and also, the spacing between axes BB-1 and BB-2 of the block 30.

Another transverse bore 54 is provided at one end of manifold 50, is adapted to receive the shank of a bolt 54' which also passes through a bore 45 in the block 30; the bolt 54' has a threaded end for co-acting with a nut 54". Each block has valve means which, for block 30, are identified in FIG. 2 by reference numerals 42, 43, and 44, which are not germane to this invention, but the details of which are available in the above-mentioned patents.

In assembly, the piston 26 is positioned with its two ends 28 and 29 positioned in the recesses 26' in the blocks 30 and 30AA. The blocks 30 and 30AA are positioned, as above described, so that the bosses 36/37 and 36'/37' are seated in the recesses 17–20 of the motor. The manifold is then positioned so that its bottom flat surface 50AA is abutting the surface 31 of blocks 30 and 30AA. Then, a plurality of suitable bolts 58' are inserted through bores 56–59, bores 34/35 and 34'/35', and thence threaded into the four threaded recesses 17'/18' in the motor end face.

The precision positioning of the recesses 17–20 in the motor end face, in combination with the precision positioning of the bosses 36 and 37 with respect to the longitudinal axis AA assures that the blocks 30 and 30AA will be in perfect alignment with the axis AA so as to receive the plunger and also with respect to the output axis of the motor 11.

Figure 4:
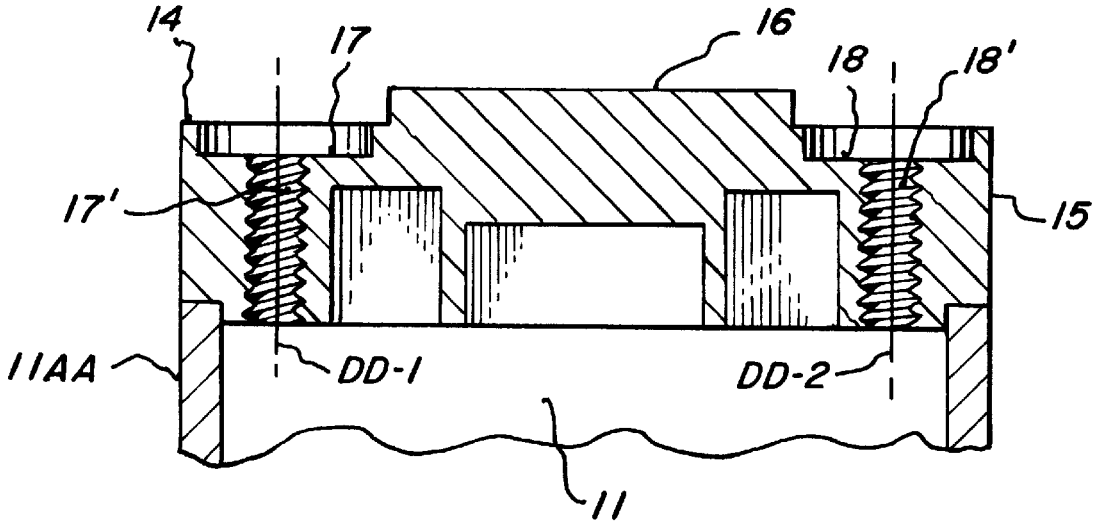
FIG. 4 is a partial cross section of the axial end of the motor 11 as viewed along section lines 4—4 of FIG. 2.
Figure 5:
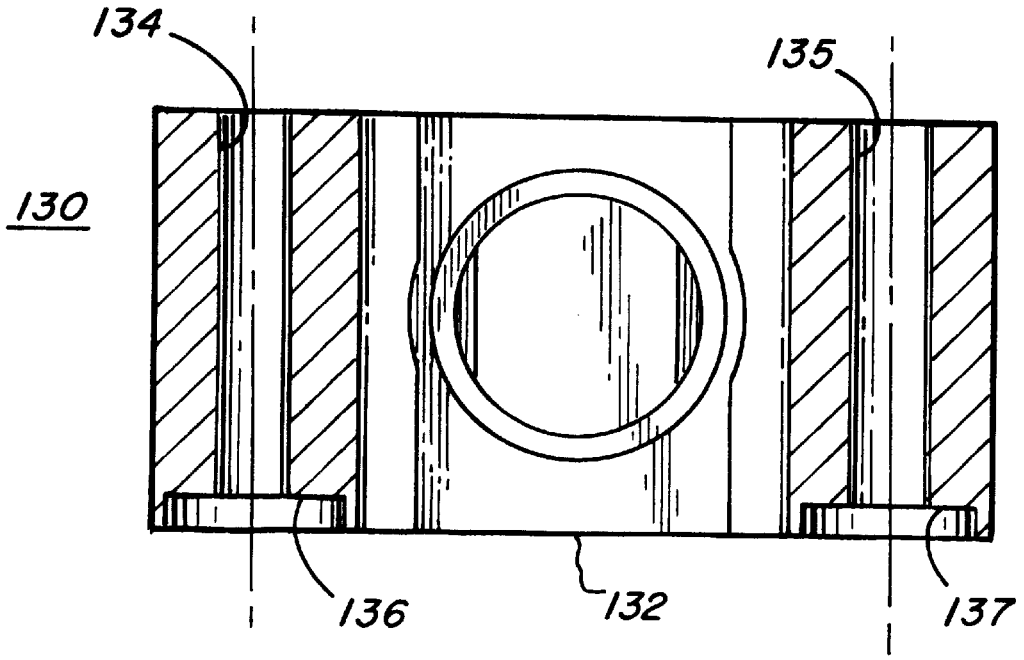
FIGS. 5 and 6 are, respectively, views of a modification of the invention, which are similar, respectively, to FIGS. 3 and 4.
Figure 6:
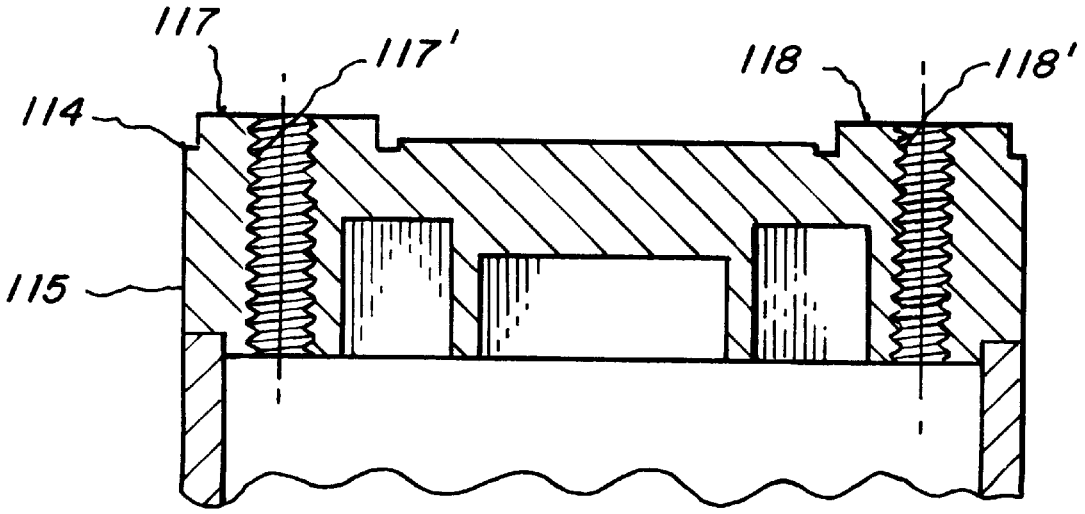

FIGS. 5 and 6 show an alternate arrangement so that the alignment means comprises bosses extending out from the axial end face of the motor to co-act with suitable recesses in the block. Thus, in FIG. 5 a block 130 has bores 134 and 135 corresponding to bores 34 and 35 of FIG. 3. Recesses 136 and 137 are provided in the motor end face engaging surface 132. FIG. 4 shows the corresponding motor end face with bosses 117 and 118 extending axially from the end face 114.

While the preferred embodiment of the invention has been illustrated, it will be understood that variations may be made by those skilled in the art without departing from the inventive concept. Accordingly, the invention is to be limited only by the scope of the following claims.

What is claimed is:

1. A double-acting simplex plunger pump comprising:

A) first and second unitary combined plunger stuffing box and head members, each member comprising:

i) a unitary block having two spaced apart parallel surfaces respectively designated a motor end face engaging surface and a pump manifold engaging surface;

ii) a plunger receiving recess in said block for receiving a cylindrically shaped plunger, said recess having a longitudinal axis lying parallel to and between said spaced apart parallel surfaces;

iii) a pair of spaced apart parallel bores:

a) having longitudinal axes lying in a plane perpendicular to said longitudinal axis of said plunger receiving recess; and b) extending through said block between and transverse to said spaced apart parallel surfaces on opposite sides of said longitudinal axis of said plunger-receiving recess; and iv) a pair of annular bosses projecting from said motor end face engaging surface, said bosses being respectively concentric with said bores, and having a preselected diameter; and B) a manifold having a longitudinal axis, a bottom flat surface adapted to be abutted by said pump manifold engaging surfaces of said first and second members, and a plurality of centrally positioned, spaced apart transverse bores normal to said manifold longitudinal axis;

C) a cylindrically shaped plunger, having at two ends thereof, pumping surfaces and a centrally located crank engageable recess;

D) a motor having a planar axial end face, and an output shaft rotatable about a shaft axis and extending axially from and perpendicular to said end face;

E) crank means on said output shaft;

F) two sets of recesses in said motor end face, each of said sets comprising a pair of recesses having a preselected diameter and spaced apart a preselected distance so as to receive a pair of said circular bosses, and said sets being positioned in said motor end face so that when said recesses are engaged by said bosses of said members, the plane defined by the bore axes of one of said members is parallel to the plane defined by the bore axes of the other of said members;

G) threaded means in said motor concentric with said recesses; and

H) screw members passing through said plurality of transverse bores of said manifold, said parallel bores of said first and second members, and into said threaded means in said motor to thereby hold in assembled relationship said motor, said first and second members with said plunger being positioned in said plunger receiving recesses of said blocks and with said crank means connected to said motor output shaft and to said centrally located crank engageable recess, and said manifold.

2. A double-acting simplex plunger pump comprising:

A) first and second unitary combined plunger stuffing box and head members, each member comprising:

i) a unitary block having two spaced apart parallel surfaces respectively designated a motor end face engaging surface and a pump manifold engaging surface;

ii) a plunger receiving recess in said block for receiving a cylindrically shaped plunger, said recess having a longitudinal axis lying parallel to and between said spaced apart parallel surfaces;

iii) a pair of spaced apart parallel bores:

a) having longitudinal axes lying in a plane perpendicular to said longitudinal axis of said plunger receiving recess; and b) extending through said block between and transverse to said spaced apart parallel surfaces on opposite sides of said longitudinal axis of said plunger-receiving recess; and iv) a pair of spaced apart circular recesses in said motor end face engaging surface concentric respectively with said pair of spaced apart parallel bores and having a preselected diameter; and B) a manifold having a longitudinal axis, a bottom flat surface adapted to be abutted by said pump manifold engaging surfaces of said first and second members, and a plurality of centrally positioned, spaced apart transverse bores normal to said manifold longitudinal axis;

C) a cylindrically shaped plunger, having at two ends thereof, pumping surfaces and a centrally located crank engageable recess;

D) a motor having a planar axial end face, and an output shaft rotatable about a shaft axis and extending axially from and perpendicular to said end face;

E) crank means on said output shaft;

F) two sets of bosses projecting normally from said motor end face, each of said sets comprising a pair of bosses having a preselected diameter and spaced apart a preselected distance so as to receive a pair of said circular recesses, and said sets being positioned on said motor end face so that when said recesses are engaged by said bosses, the plane defined by the bore axes of one of said members is parallel to the plane defined by the bore axes of the other of said members;

G) threaded means in said motor concentric with said bosses; and

H) screw members passing through said plurality of transverse bores of said manifold, said parallel bores of said first and second members, and into said threaded means in said motor to thereby hold in assembled relationship said motor, said first and second members with said plunger being positioned in said plunger receiving recesses of said blocks and with said crank means connected to said motor output shaft and to said centrally located crank engageable recess, and said manifold.

3. A double-acting simplex plunger pump comprising:

A) first and second combined plunger stuffing box and head members, each member comprising:

i) a block having two spaced apart parallel surfaces respective designated a motor end face engaging surface and a pump manifold engaging surface;

ii) a plunger receiving recess in said block for receiving a plunger, said recess having a longitudinal axis lying parallel to and between said spaced apart parallel surfaces;

iii) a pair of spaced apart parallel bores:

a) having longitudinal axes lying in a plane perpendicular to said longitudinal axis of said plunger receiving recess; and b) extending through said block between and transverse to said spaced apart parallel surfaces on opposite sides of said longitudinal axis of said plunger-receiving recess; and iv) a first pair of alignment means on said motor end face engaging surface and being respectively concentric with said bores; and B) a manifold having a longitudinal axis, a bottom flat surface adapted to be abutted by said pump manifold engaging surfaces of said first and second members, and a plurality of centrally positioned, spaced apart transverse bores normal to said manifold longitudinal axis;

C) a plunger, having at two ends thereof, pumping surfaces and a crank engageable recess;

D) a motor having a planar axial end face, and an output shaft rotatable about a shaft axis and extending axially from and perpendicular to said end face;

E) crank means on said output shaft;

F) two sets of alignment means in said motor end face, each of said sets comprising a pair of alignment means spaced apart a preselected distance so as to engage a pair of said alignment means or said stuffing box and head members, and said sets being positioned in said motor end face so that when said alignment means are engaged, the plane defined by the bore axes of one of said members is parallel to the plane defined by the bore axes of the other of said members;

G) threaded means in said motor concentric with said bores; and

H) screw members passing through said plurality of transverse bores of said manifold, said parallel bores of said first and second members, and into said threaded means in said motor to thereby hold in assembled relationship: said motor, said first and second members with said plunger being positioned in said plunger receiving recesses of said blocks and with said crank means connected to said motor output shaft and to said centrally located crank engageable recess, and said manifold.

4. The pump of claim 3 wherein said alignment means on said motor end face engaging surfaces of said members comprise a pair of circular bosses and aid alignments means in said motor end face comprise circular recesses.

5. The pump of claim 3 wherein said alignment means on said motor end face engaging surfaces of said members comprises circular recesses and said alignment means in said motor end face comprise circular bosses.

* * * * *